US007584956B2

(12) United States Patent
Yamagishi

(10) Patent No.: US 7,584,956 B2
(45) Date of Patent: Sep. 8, 2009

(54) IMAGE FORMING APPARATUS, SHEET SIZE DETECTION DEVICE, AND SHEET SIZE DETECTION METHOD

(75) Inventor: Masaru Yamagishi, Kawasaki (JP)

(73) Assignee: Ricoh Company Ltd., Tokyo (JP)

( * ) Notice: Subject to any disclaimer, the term of this patent is extended or adjusted under 35 U.S.C. 154(b) by 0 days.

(21) Appl. No.: 12/222,929

(22) Filed: Aug. 20, 2008

(65) Prior Publication Data

US 2009/0051101 A1 Feb. 26, 2009

(30) Foreign Application Priority Data

Aug. 20, 2007 (JP) ..... 2007-213943

(51) Int. Cl.
*B65H 1/00* (2006.01)

(52) U.S. Cl. ..... 271/171; 399/393

(58) Field of Classification Search ..... 271/171; 399/393

See application file for complete search history.

(56) References Cited

U.S. PATENT DOCUMENTS

| | | | |
|---|---|---|---|
| 6,690,911 | B2 | 2/2004 | Yamagishi |
| 2002/0127039 | A1 | 9/2002 | Yamagishi |
| 2006/0087073 | A1 * | 4/2006 | Yamagishi ..... 271/171 |
| 2006/0164456 | A1 | 7/2006 | Yamagishi et al. |

FOREIGN PATENT DOCUMENTS

| | | | |
|---|---|---|---|
| JP | 06-032489 | | 2/1994 |
| JP | 07-251951 | | 10/1995 |
| JP | 09325545 | A * | 12/1997 |
| JP | 2005-280994 | | 10/2005 |
| JP | 2006-137597 | | 6/2006 |
| JP | 2006-188357 | | 7/2006 |

* cited by examiner

*Primary Examiner*—Patrick H Mackey
*Assistant Examiner*—Gerald W McClain
(74) *Attorney, Agent, or Firm*—Harness, Dickey & Pierce

(57) ABSTRACT

An image forming apparatus includes a sheet size detection device including a sheet width direction regulating member, a sheet conveyance direction regulating member, two levers, a detection sensor, and a pattern supplementing device. The levers each have a concavo-convex pattern and interlock with the regulating members, respectively, and are superimposed to have the same center of rotation and the same locus formed by a leading end of the concavo-convex pattern. The concavo-convex pattern of at least one of the levers is shaped to prevent, in a detection pattern, erroneous detection attributed to positional displacement of the concavo-convex pattern. The detection sensor including push switches detects the sheet size according to a combined concavo-convex pattern formed by the superimposed levers. The pattern supplementing device supplements the concavo-convex pattern of the at least one lever to prevent, in another detection pattern, erroneous detection attributed to the shaping of the concavo-convex pattern.

13 Claims, 14 Drawing Sheets

FIG. 9

| No. | SHEET SIZE | END FENCE POSITION | SIDE FENCE POSITION | CONCAVO-CONVEX PATTERN | | | | | | | | | | DETECTION SIGNAL (COMBINED PATTERN) | | | | |
|---|---|---|---|---|---|---|---|---|---|---|---|---|---|---|---|---|---|---|
| | | | | END FENCE | | | | | SIDE FENCE | | | | | | | | | |
| | | | | A | B | C | D | E | A | B | C | D | E | A | B | C | D | E |
| 1 | 12″×18″ | 18″ | 12″ | 1 | 1 | 1 | 1 | 0 | 1 | 0 | 0 | 0 | 1 | 1 | 1 | 1 | 1 | 1 |
| 2 | DLT(11″×17″) | 17″ | 11″ | 1 | 1 | 1 | 0 | 0 | 0 | 1 | 1 | 0 | 0 | 1 | 1 | 1 | 0 | 0 |
| 3 | LG(8.5″×14″) | 14″ | 8.5″ | 0 | 0 | 1 | 1 | 0 | 1 | 0 | 0 | 1 | 0 | 1 | 0 | 1 | 1 | 0 |
| 4 | Folio(8.25″×13″) | 13″ | A5Y/A4T/8.25″ | 0 | 1 | 0 | 1 | 1 | 0 | 1 | 0 | 0 | 1 | 0 | 1 | 0 | 1 | 1 |
| 5 | F4(8.5″×13″) | 13″ | 8.5″ | 0 | 1 | 0 | 1 | 1 | 1 | 0 | 0 | 1 | 0 | 1 | 1 | 0 | 1 | 1 |
| 6 | F(8″×13″) | 13″ | 8″ | 0 | 1 | 0 | 1 | 1 | 0 | 0 | 1 | 0 | 0 | 0 | 1 | 1 | 1 | 1 |
| 7 | LTT(8.5″×11″) | 11″ | 8.5″ | 1 | 1 | 0 | 0 | 0 | 1 | 0 | 0 | 1 | 0 | 1 | 1 | 0 | 1 | 0 |
| 8 | LTY | 8.5″ | 11″ | 0 | 1 | 1 | 0 | 0 | 0 | 1 | 1 | 0 | 0 | 0 | 1 | 1 | 0 | 0 |
| 9 | HLTT | 8.5″ | 5.5″ | 0 | 1 | 1 | 0 | 0 | 0 | 1 | 1 | 1 | 0 | 0 | 1 | 1 | 1 | 0 |
| 10 | HLTY | 5.5″ | 8.5″ | 0 | 1 | 1 | 0 | 0 | 1 | 0 | 0 | 1 | 0 | 1 | 1 | 1 | 1 | 0 |
| 11 | Exective(7.25″×10.5″)T | 16T/10.5″ | B5T(7.25″) | 0 | 0 | 0 | 0 | 0 | 1 | 0 | 1 | 0 | 0 | 1 | 0 | 1 | 0 | 0 |
| 12 | Exective(7.25″×10.5″)Y | B5Y(7.25″) | 16KY/8KT/10.5″ | 0 | 0 | 0 | 1 | 1 | 0 | 0 | 1 | 1 | 0 | 0 | 0 | 1 | 1 | 1 |
| 13 | A3 | A3T | A3T/A4Y | 1 | 1 | 0 | 0 | 1 | 1 | 0 | 0 | 0 | 0 | 1 | 1 | 0 | 0 | 1 |
| 14 | B4 | B4T | B5Y/B4T | 1 | 0 | 0 | 1 | 1 | 0 | 0 | 0 | 1 | 1 | 1 | 0 | 0 | 1 | 1 |
| 15 | A4T | A4T | A5Y/A4T/8.25″ | 0 | 1 | 0 | 0 | 1 | 0 | 1 | 0 | 0 | 1 | 0 | 1 | 0 | 0 | 1 |
| 16 | B5T | B5T | B5T(7.25″) | 0 | 0 | 0 | 0 | 1 | 1 | 0 | 1 | 0 | 0 | 1 | 0 | 1 | 0 | 1 |
| 17 | A4Y | A4Y/A5T | A3T/A4Y | 1 | 1 | 0 | 0 | 0 | 1 | 1 | 0 | 0 | 0 | 1 | 1 | 0 | 0 | 0 |
| 18 | A5T | A4Y/A5T | A5Y/A4T/8.25″ | 1 | 1 | 0 | 0 | 0 | 1 | 1 | 1 | 0 | 1 | 1 | 1 | 1 | 0 | 1 |
| 19 | B5Y | B5Y(7.25″) | B5Y/B4T | 0 | 0 | 0 | 1 | 1 | 0 | 0 | 0 | 1 | 1 | 0 | 0 | 0 | 1 | 1 |
| 20 | A5Y | A5Y | A5Y/A4T/8.25″ | 0 | 1 | 1 | 0 | 0 | 0 | 1 | 0 | 0 | 1 | 0 | 1 | 1 | 0 | 1 |
| 21 | 8KT | 8KT | 16KY/8KT/10.5″ | 0 | 0 | 1 | 1 | 0 | 0 | 0 | 1 | 1 | 0 | 0 | 0 | 1 | 1 | 0 |
| 22 | 16KT | 16KT/10.5″ | 16KT | 0 | 0 | 0 | 0 | 0 | 1 | 0 | 0 | 1 | 0 | 1 | 0 | 0 | 1 | 0 |
| 23 | 16KY | 16KY | 16KY/8KT/10.5″ | 1 | 0 | 0 | 0 | 1 | 0 | 0 | 1 | 1 | 0 | 1 | 0 | 1 | 1 | 1 |

IMAGE FORMING APPARATUS, SHEET SIZE DETECTION DEVICE, AND SHEET SIZE DETECTION METHOD

CROSS-REFERENCE TO RELATED APPLICATIONS

This application claims priority to Japanese Patent Application No. 2007-213943 filed on Aug. 20, 2007, the entire contents of which are hereby incorporated by reference herein.

BACKGROUND OF THE INVENTION

1. Field of the Invention

The present patent application relates to a sheet size detection device and method for detecting multiple sheet sizes, and an image forming apparatus, such as a multifunctional machine including at least one of a copier, a printer, a facsimile machine, and a plotter, that includes the sheet size detection device and employs the sheet detection method.

2. Discussion of the Background Art

According to a background technique, a machine is caused to recognize the sizes of recording sheets stacked on a tray thereof on the basis of a manual operation performed by an operator. In the event of an operating error on the part of the operator, however, the machine cannot check the error. As a result, a failure such as a paper jam occurs.

Even in a machine provided with a tray capable of detecting the sheet sizes, if the detection is based on a method of detecting the sheet sizes only in a sheet conveyance direction, the detectable sheet sizes are limited. Meanwhile, there are mechanisms which detect the sheet sizes both in the sheet conveyance direction and a sheet width direction. Such mechanisms, however, only provide a general indication of the sheet sizes. Consequently, the detectable sheet sizes are limited, or the costs are increased due to multiple sensors provided to precision detection of the sheet sizes.

In the event of an error in the detection of a sheet size, even if a paper jam does not occur, an image forming unit performs such processes as the transfer of a toner image and the cleaning of toner remaining after the transfer process, in an area larger than the area of a recording sheet. As a result, a process cartridge is consumed more quickly and thus replaced more frequently. In other words, the life of the process cartridge is shortened.

In the control of a sheet feeding and separating unit, a situation is assumed in which the sheet size is unknown or the sheet size has been erroneously set. Therefore, it is necessary to bring forward the timing of stopping the drive of a feed roller included in the sheet feeding and separating unit. As a result, a sheet slip suppressing area is reduced, and the accuracy of sheet conveyance is degraded. Such deterioration affects productivity.

There are known sheet size detection devices for preventing the above-described undesirable phenomena attributable to operator error. Each of the background devices includes side fences and an end fence each slidable and positioned according to the sheet size, two levers interlocking with the side fences and the end fence, respectively, and a detection sensor including multiple push switch elements.

Each of the levers includes a concavo-convex pattern used for the recognition of the sheet sizes. The levers are superimposed to have the same center of rotation and the same locus formed by the leading end of the concavo-convex pattern away from the center of rotation. The thus-superimposed concavo-convex patterns form a combined concavo-convex pattern for selectively pressing the multiple push switch elements. With this configuration, multiple sheet sizes can be detected.

Along with the diversification of sheet sizes in the market, however, the possibility of erroneous recognition of the sheet sizes has been increasing, and a more minute concavo-convex pattern of the levers has been increasingly required. Further, greater accuracy of the operation performed by the operator is also required.

In an area of the concavo-convex pattern in which adjacent convex portions are closely located near each other, even a slight positional displacement of the side fences and the end fence can cause a change or a shift in the overall combined concavo-convex pattern. As a result, there is a risk of erroneous recognition of the sheet size.

Therefore, each of the fences needs to be accurately set at the position for the intended sheet size. Further, accuracy is constantly required in the sheet setting operation performed by the operator. In view of the above issue, it is conceivable to lower the detection accuracy by increasing the distance between the adjacent convex portions of the concavo-convex pattern. In such a case, however, the number of detectable sheet sizes is reduced.

According to one known sheet size detection device, a sheet feeding tray includes a member for locking, at a determined position, each of the fences serving as regulating members. However, it is easily predictable that the operator may forget to perform the locking operation.

If the operator forgets to perform the locking operation, the possibility of erroneous detection caused by the positional displacement of the fences is increased due to such factors as the shock caused in the attachment of the sheet feeding tray to the body of an image forming apparatus, the vibration occurring in an image forming operation, and the shock caused by unexpected external force exerted on the sheet feeding tray or the body of the image forming apparatus.

SUMMARY OF THE INVENTION

This patent specification describes an image forming apparatus. In one example, a sheet size detection device detects multiple sheet sizes, and includes a sheet width direction regulating member, a sheet conveyance direction regulating member, two levers, a detection sensor, and a pattern supplementing device. The sheet width direction regulating member is slidable and positioned in accordance with the sheet size of a recording sheet to regulate a sheet width direction. The sheet conveyance direction regulating member is slidable and positioned in accordance with the sheet size of the recording sheet to regulate a sheet conveyance direction substantially perpendicular to the sheet width direction. The two levers each have a concavo-convex pattern, interlock with the sheet width direction regulating member and the sheet conveyance direction regulating member, respectively, and are superimposed in a sheet stacking direction to have the same center of rotation and the same locus formed by a leading end of the concavo-convex pattern away from the center of rotation. The concavo-convex pattern of at least one of the levers is shaped to prevent, in a particular detection pattern, erroneous detection attributed to positional displacement of the concavo-convex pattern. The detection sensor includes multiple push switches to detect the sheet size of the recording sheet in accordance with a combined concavo-convex pattern formed by the superimposed levers to selectively press the push switches. The pattern supplementing device supplements the concavo-convex pattern of the at least one lever to prevent, in another detection pattern, erroneous detection attributed to the shaping of the concavo-convex pattern for preventing the erroneous detection attributed to the positional displacement of the concavo-convex pattern with respect to the push switches.

This patent specification further describes a sheet size detection device. In one example, an image forming apparatus includes an image forming mechanism configured to form an image on a recording sheet, and a sheet size detection device configured to detect multiple sheet sizes. The sheet size detection device includes a sheet width direction regulating member, a sheet conveyance direction regulating member, two levers, a detection sensor, and a pattern supplementing device. The sheet width direction regulating member is slidable and positioned in accordance with the sheet size of the recording sheet to regulate a sheet width direction. The sheet conveyance direction regulating member is slidable and positioned in accordance with the sheet size of the recording sheet to regulate a sheet conveyance direction substantially perpendicular to the sheet width direction. The two levers each have a concavo-convex pattern, interlock with the sheet width direction regulating member and the sheet conveyance direction regulating member, respectively, and are superimposed in a sheet stacking direction to have the same center of rotation and the same locus formed by a leading end of the concavo-convex pattern away from the center of rotation. The concavo-convex pattern of at least one of the levers is shaped to prevent, in a particular detection pattern, erroneous detection attributed to positional displacement of the concavo-convex pattern. The detection sensor includes multiple push switches to detect the sheet size of the recording sheet in accordance with a combined concavo-convex pattern formed by the superimposed levers to selectively press the push switches. The pattern supplementing device supplements the concavo-convex pattern of the at least one lever to prevent, in another detection pattern, erroneous detection attributed to the shaping of the concavo-convex pattern for preventing the erroneous detection attributed to the positional displacement of the concavo-convex pattern with respect to the push switches.

This patent specification further describes a sheet size detection method. In one example, a sheet size detection method detects multiple sheet sizes, and includes: forming a concavo-convex pattern in each of two levers such that the concavo-convex pattern of at least one of the levers is shaped to prevent, in a particular detection pattern, erroneous detection attributed to positional displacement of the concavo-convex pattern with respect to multiple push switches forming a detection sensor; superimposing the levers in a sheet stacking direction such that the levers have the same center of rotation and the same locus formed by a leading end of the concavo-convex pattern away from the center of rotation; regulating a sheet width direction in accordance with the sheet size of a recording sheet; regulating a sheet conveyance direction substantially perpendicular to the sheet width direction in accordance with the sheet size of the recording sheet; supplementing, when necessary, the concavo-convex pattern of the at least one lever to prevent, in another detection pattern, erroneous detection attributed to the shaping of the concavo-convex pattern of the at least one lever; and detecting the sheet size of the recording sheet in accordance with a combined concavo-convex pattern formed by the superimposed levers to selectively press the push switches.

BRIEF DESCRIPTION OF THE DRAWINGS

A more complete appreciation of the present patent application and many of the advantages thereof are obtained as the same becomes better understood by reference to the following detailed description when considered in connection with the accompanying drawings, wherein:

FIG. 9 is a table illustrating the relationships between the sheet sizes and the concavo-convex patterns and so forth;

DETAILED DESCRIPTION OF THE INVENTION

Figure 1:
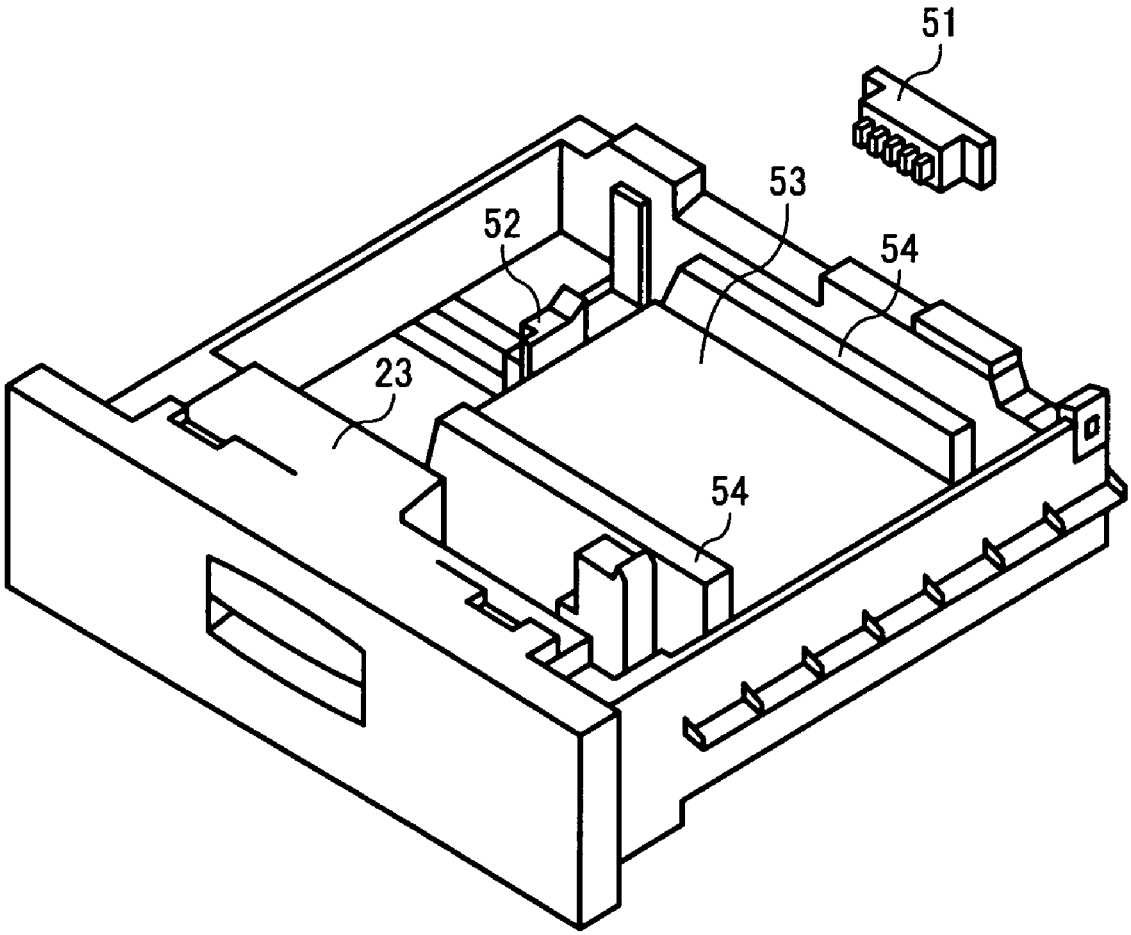
FIG. 1 is a perspective view of a sheet feeding tray provided with a sheet size detection device according to a first example embodiment of the present patent application.

In describing the example embodiments illustrated in the drawings, specific terminology is employed for the purpose of clarity. However, the disclosure of this patent specification is not intended to be limited to the specific terminology so used, and it is to be understood that substitutions for each specific element can include any technical equivalents that operate in a similar manner.

Referring now to the drawings, wherein like reference numerals designate identical or corresponding parts throughout the several views, particularly to FIGS. 1 to 15, description will be first made of a first example embodiment of the present patent application.

FIG. 1 illustrates a sheet feeding tray 23 serving as a tray from which a recording sheet (a recording medium) is fed and sent out. Side fences 54 and an end fence 52 regulate a sheet bundle 53 of recording sheets to prevent positional displacement of the sheet bundle 53. Each of the side fences 54 is slidingly movable, and serves as a sheet width direction regulating member. The end fence 52 is also slidingly movable, and serves as a sheet conveyance direction regulating member.

The body of an image forming apparatus (not illustrated) includes a sheet size detection sensor (hereinafter referred to as the detection sensor), 51, which is provided independently of the sheet feeding tray 23 and includes multiple push switches later described.

Figure 2:
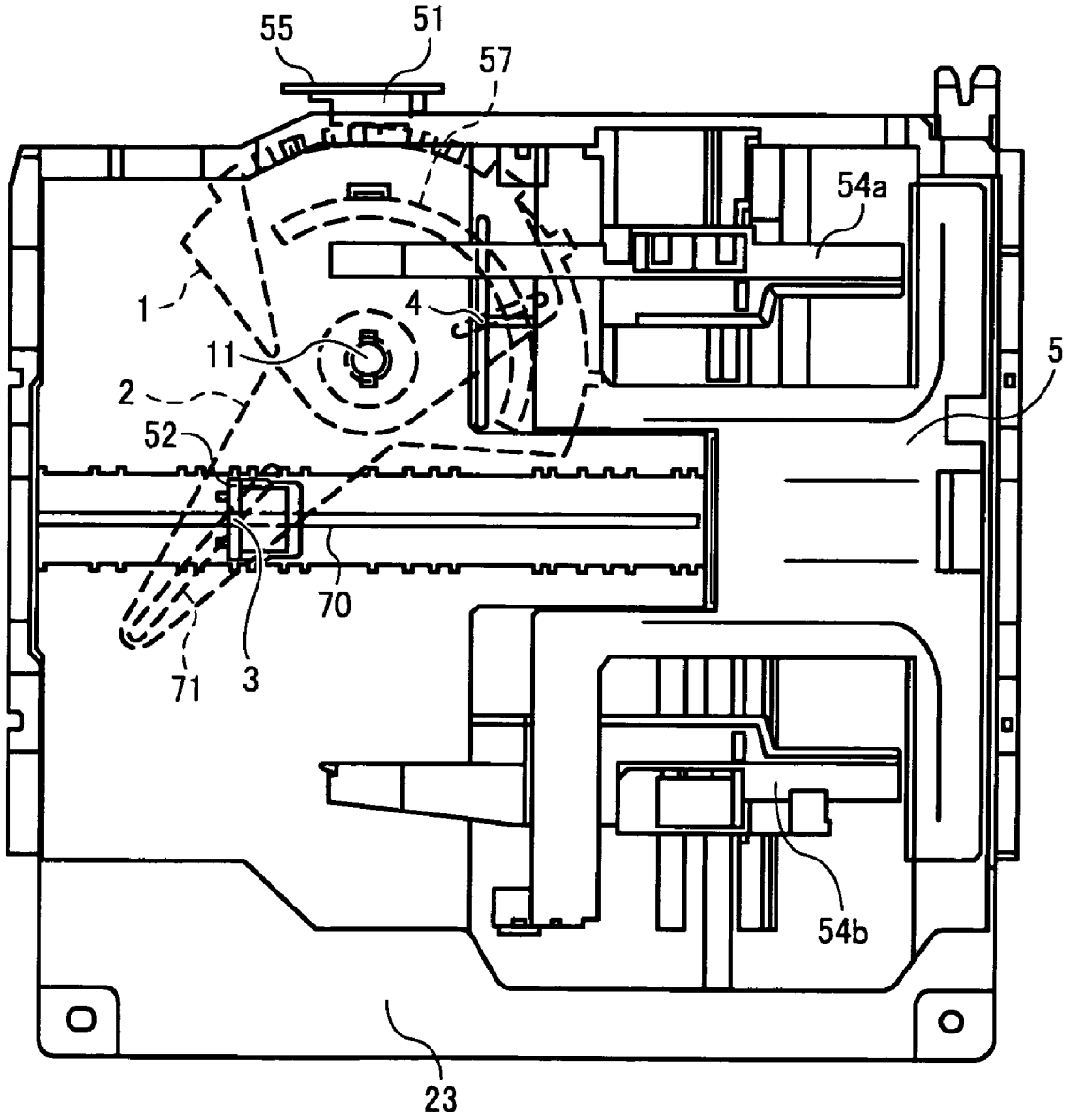
FIG. 2 is a plan view of the sheet feeding tray after the attachment thereof to the body of an image forming apparatus.
Figure 3:
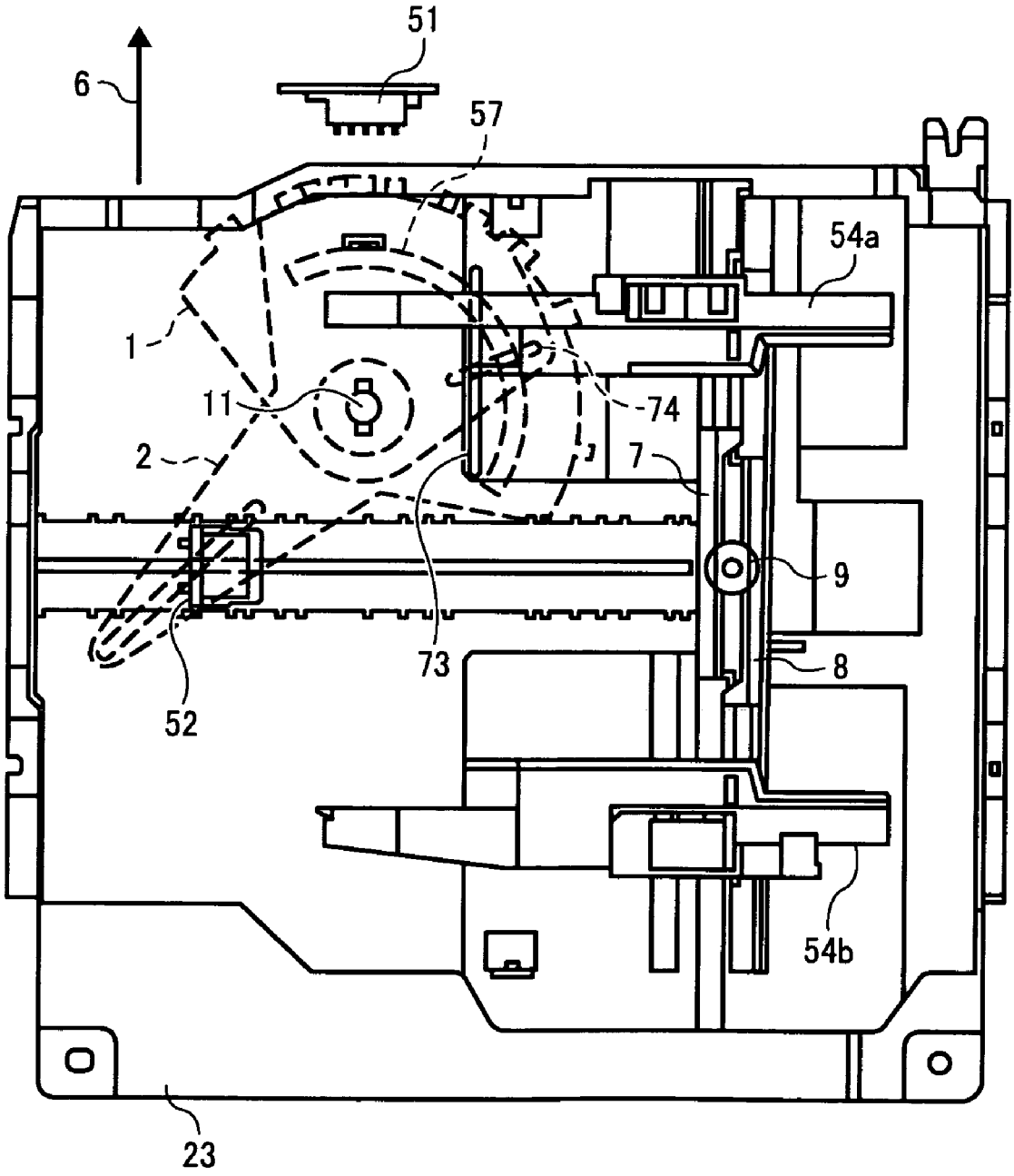
FIG. 3 is a plan view of the sheet feeding tray immediately before the attachment thereof to the body of the image forming apparatus.
Figure 4:
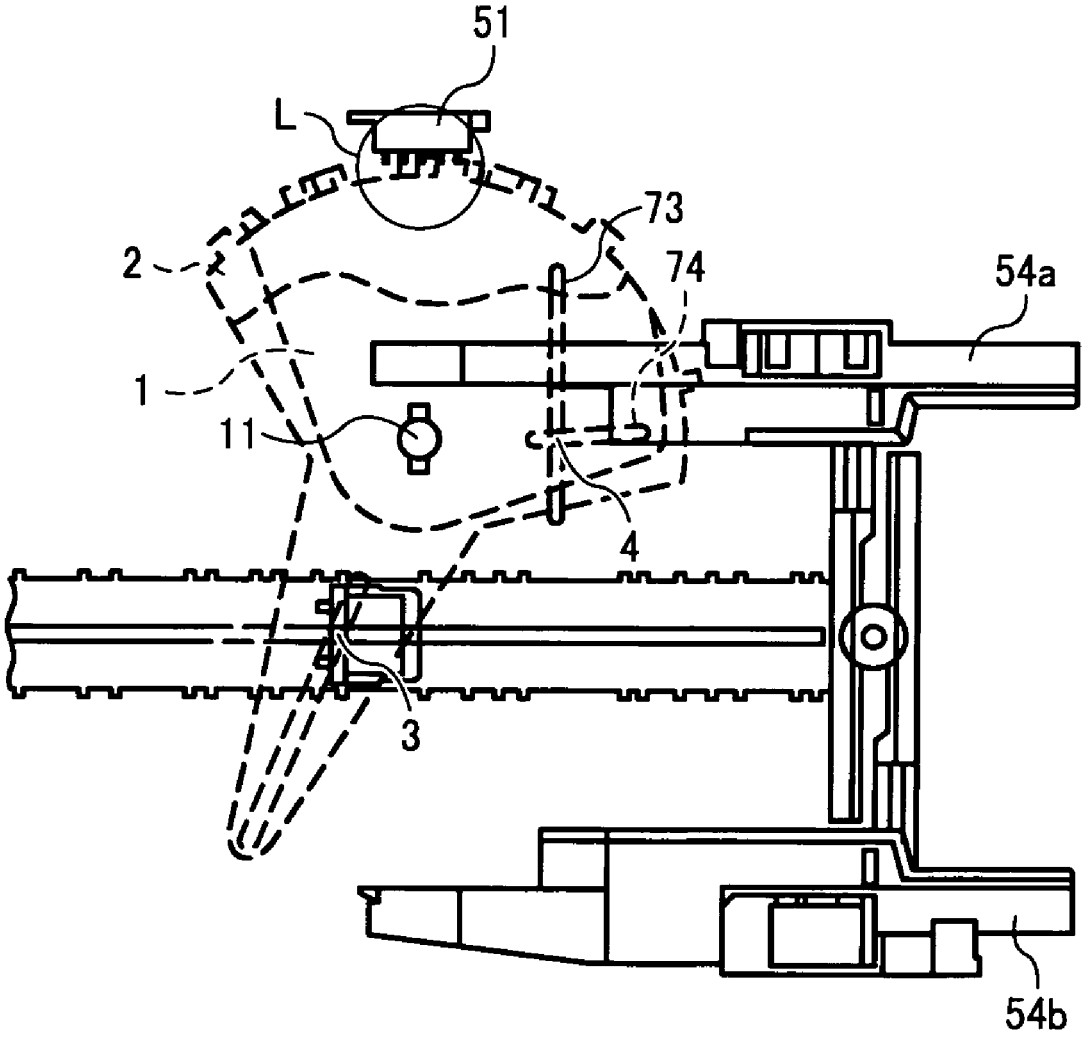
FIG. 4 is a plan view illustrating a combined concavo-convex pattern formed by the concavo-convex patterns of respective levers.
Figure 5A:
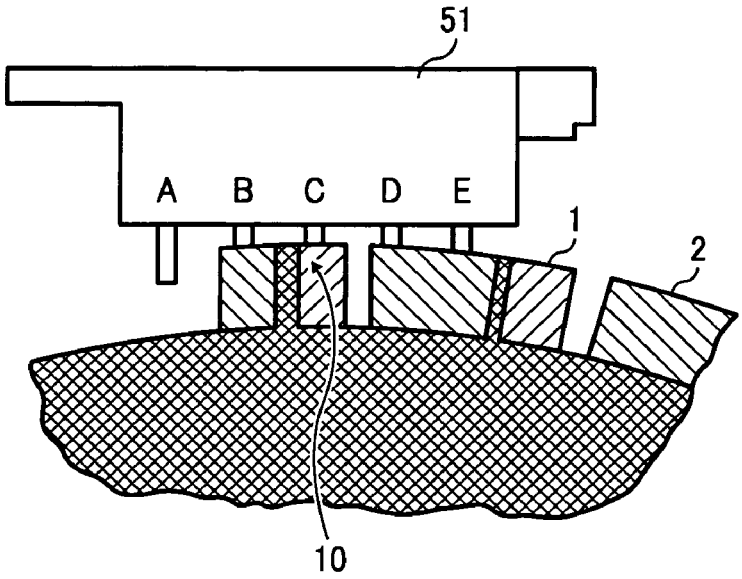
FIG. 5A is a diagram illustrating the relationship between the combined concavo-convex pattern and a detection sensor, particularly illustrating an enlarged view of an encircled portion of FIG. 4.
Figure 5B:
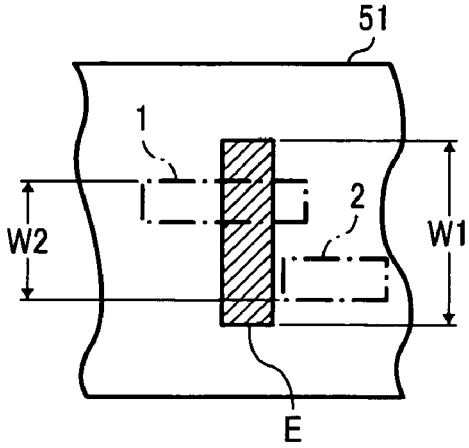
FIG. 5B is a diagram illustrating the relationship between the combined concavo-convex pattern and the detection sensor, particularly illustrating the relationship between the width or height of a push switch and the width or height of the combined concavo-convex pattern.
Figure 6:
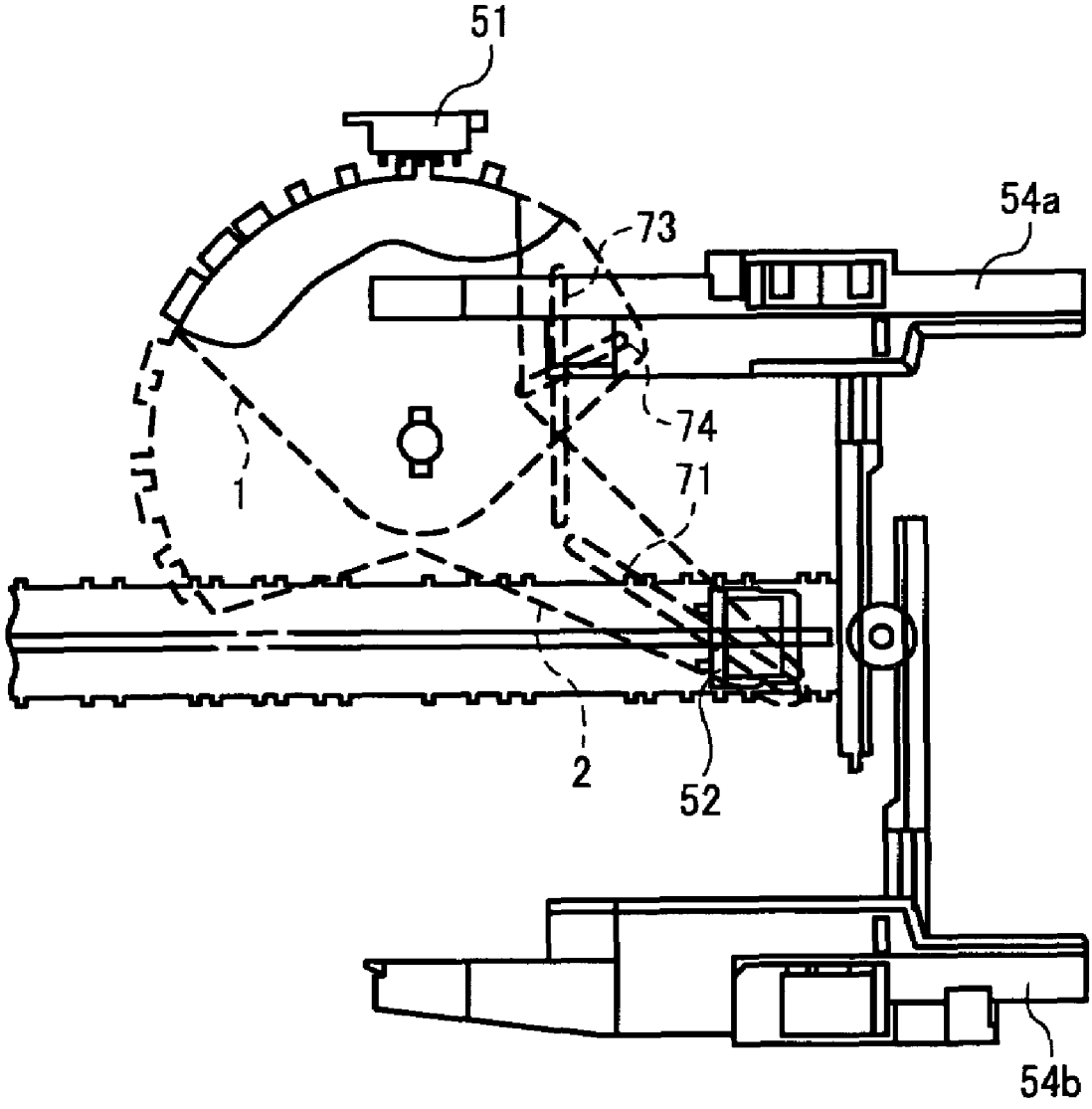
FIG. 6 is a plan view illustrating interlocking displacement of the respective levers occurring when an end fence and side fences are moved.

FIGS. 2 and 3 illustrate a detailed configuration of the sheet feeding tray 23. FIGS. 4, 5A, and 5B illustrate in detail an interlocking mechanism of the side fences 54 (hereinafter referred to as the side fences 54*a* and 54*b*), the end fence 52, and levers 1 and 2 each including a concavo-convex pattern.

FIGS. 2 and 3 illustrate the sheet feeding tray 23, the side fences 54*a* and 54*b*, the end fence 52, the detection sensor 51, and the levers 1 and 2. The sheet feeding tray 23 includes a bottom plate 5, and is formed with long holes 70 and 73. The side fence 54*a* includes a side fence interlocking shaft 4. The end fence 52 includes an end fence interlocking shaft 3. The levers 1 and 2 include a center of rotation 11 and a groove 57. The lever 1 is formed with a long hole 74, and the lever 2 is formed with a long hole 71. The detection sensor 51 is provided on a side plate 55 of the body of the image forming apparatus (not illustrated). The side fences 54*a* and 54*b* are provided with racks 7 and 8 and a pinion gear 9.

As illustrated in FIG. 2, the sheet feeding tray 23 includes the bottom plate 5 for elevating the recording sheets of the sheet bundle 53 (not illustrated) stacked thereon to an arbitrary position. As described above, the sheet bundle 53 is regulated in the sheet width direction perpendicular to the sheet conveyance direction by the slidable side fences 54*a* and 54*b*, and is regulated in the sheet conveyance direction by the slidable end fence 52.

The end fence interlocking shaft 3 located under the sheet feeding tray 23 is engaged in the long hole 71 of the lever 2 via the long hole 70 of the sheet feeding tray 23. Along with the sliding movement of the end fence 52, the end fence interlocking shaft 3 is moved in the long hole 71 of the lever 2 to rotationally move the lever 2 about the center of rotation 11 shown in FIG. 4.

As illustrated in FIG. 3, the side fences 54*a* and 54*b* are moved in the sheet width direction by the racks 7 and 8 and the pinion gear 9 provided thereto. Further, as illustrated in FIG. 4, the side fence interlocking shaft 4 provided to the side fence 54*a* on the far side in the drawing is engaged in the long hole 74 of the lever 1 via the long hole 73 of the sheet feeding tray 23 extending in the sheet width direction. Along with the sliding movement of the side fences 54*a* and 54*b*, the side fence interlocking shaft 4 is moved in the long hole 74 of the lever 1 to rotationally move the lever 1 about the center of rotation 11 illustrated in FIG. 4.

The end fence 52, the side fences 54*a* and 54*b*, the levers 1 and 2, the detection sensor 51, and so forth constitute a sheet size detection device.

If the sheet feeding tray 23 is attached to the body of the image forming apparatus in an insertion direction or a setting direction indicated by an arrow 6 in FIG. 3, the concavo-convex pattern formed on the leading end of each of the levers 1 and 2 faces and comes into pressure contact with the detection sensor 51 provided to the side plate 55 of the body of the image forming apparatus, not shown, as illustrated in FIG. 2.

In this case, as illustrated in FIG. 5A illustrating an enlarged view of an encircled portion L of FIG. 4, a combined concavo-convex pattern formed by the respective concavo-convex patterns of the levers 1 and 2 arbitrarily presses the push switches of the detection sensor 51. As a result, an ON signal is emitted from the pressed push switches. In FIG. 5A, a dotted portion corresponds to an overlapping portion of the levers 1 and 2.

As illustrated in FIG. 5B, each of the push switches (a push switch E is herein illustrated as an example) has a width w1 in the vertical direction. The width w1 is set to be greater than a width w2 of the combined concavo-convex pattern formed by the levers 1 and 2.

FIGS. 4, 5A, 5B, and 6 illustrate a change in convex and concave portions of the combined concavo-convex pattern for pressing the push switches of the detection sensor 51. The change is caused by the movements of the levers 1 and 2 in accordance with the movements of the side fences 54*a* and 54*b* and the end fence 52. As the two superimposed levers 1 and 2 are rotationally moved, a combination of the concavo-convex patterns of the levers 1 and 2 forms a combined concavo-convex pattern or a combined pattern for pressing the push switches of the detection sensor 51.

Figure 7:
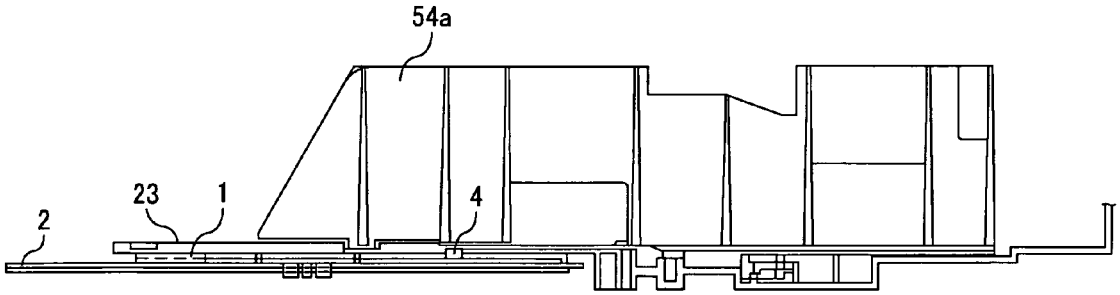
FIG. 7 is a longitudinal sectional view of essential parts of the sheet feeding tray, illustrating the positional relationship of the levers in the vertical direction.
Figure 8:
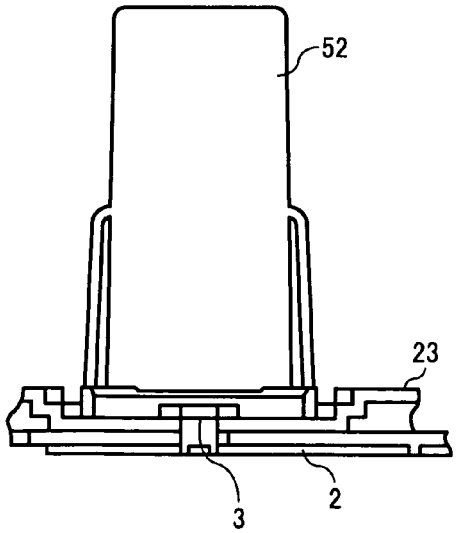
FIG. 8 is a longitudinal sectional view of essential parts of the sheet feeding tray in the vicinity of the end fence.

FIG. 7 illustrates an overlapping configuration of the two levers 1 and 2. In the sectional view of the sheet feeding tray 23, the levers 1 and 2 are configured such that the side fence interlocking shaft 4 of the side fence 54*a* on the far side of the drawing interlocks with the lever 1, and that the lever 1 is superimposed on the lever 2. FIG. 8 illustrates a configuration in which the lever 2 interlocks with the end fence interlocking shaft 3 of the end fence 52.

FIG. 9 illustrates combinations of the concavo-convex patterns of the levers 1 and 2. In the table of FIG. 9, A to E represent the push switches or the push switch elements of the detection sensor 51 illustrated in FIG. 4. In the table, the value 0 represents the OFF state in which the switch is not pressed, i.e., the switch faces a concave portion of the combined concavo-convex pattern, while the value 1 represents the ON state in which the switch is pressed, i.e., the switch faces a convex portion of the combined concavo-convex pattern.

As illustrated in FIG. 5A, in the formation of the concave and convex portions by the levers 1 and 2, it is difficult to make the concave and convex portions constantly fit with the intervals of the push switches of the detection sensor 51. As indicated by an arrow 10, therefore, an end portion of the concavo-convex pattern of the lever 2 may fail to come into contact with a push switch C by a small margin, for example.

In this case, however, the intervals of the push switches produced in the mass production do not always cause the contact failure between the push switch C and the corresponding convex portion. Thus, a configuration can be formed in which the concavo-convex pattern of the lever 1 presses the push switch C to enable mutual supplementation between the concavo-convex pattern of the lever 1 and the concavo-convex pattern of the lever 2.

If the types of the detectable sheet sizes are increased, however, the distance between adjacent convex portions of the concavo-convex patterns is reduced. As a result, if the setting of the side fences 54*a* and 54*b* is not sufficiently accurate, e.g., if the width between the side fences 54*a* and 54*b* is increased due to a setting error caused by an operator, the misalignment of the sheet bundle 53, the shock caused in the setting of the sheet feeding tray 23, and so forth, a detection pattern may become different from the information of the actually set recording sheet. Herein, the detection pattern refers to the combined concavo-convex pattern obtained in a state in which there is no positional displacement in the respective positioning fences, i.e., the side fences 54*a* and 54*b* and the end fence 52, corresponding to the sheet size.

For example, as illustrated in FIG. 9, in the detection of a generally frequently used sheet size of A4Y, the concavo-convex pattern corresponding to the lever 1 interlocking with the side fences 54*a* and 54*b* is 11000, and the concavo-convex pattern corresponding to the lever 2 interlocking with the end fence 52 is 11000. From the combination of the above concavo-convex patterns, a detection signal having a value 10000 is synthesized.

It is now assumed that the positions of the side fences 54*a* and 54*b* have been shifted for some reason from the side fence positions for the width of the A4Y sheet size, which is 297 millimeters, to the side fence positions for the width of a 12-inch sheet size, which is 305 millimeters, one size larger than the A4Y sheet size. In this case, as observed from FIG. 9, the concavo-convex pattern corresponding to the side fences 54*a* and 54*b* shifts from 11000 to 10001. As a result, a detection signal having a value 11001 is synthesized from the concavo-convex pattern 10001 corresponding to the side fences 54*a* and 54*b* and the concavo-convex pattern 11000 corresponding to the end fence 52.

The thus obtained concavo-convex pattern 11001 corresponds to the detection pattern of an A3 sheet size. However, the actually set recording sheet has the A4Y sheet size. Therefore, if the operation of feeding the recording sheet is performed in this state, a paper jam is caused. Even if the paper jam does not occur, an image forming unit performs, in an area larger than the area of the recording sheet, such processes as the transfer of a toner image and the cleaning of toner remaining after the transfer process. Therefore, a process cartridge is replaced more frequently, and the life of the process cartridge is shortened.

In a system such as a color image forming apparatus using an intermediate transfer belt, an image writing process may start before the sheet feeding operation starts. In this case, if the paper jam occurs due to the erroneous sheet size detection, the image in the writing process is discarded. As a result, wasteful toner consumption and the cleaning operation of the respective parts are inevitable.

The present patent application prevents the erroneous detection even in the event of the above-described accidental failure such as the setting error.

Figure 10:
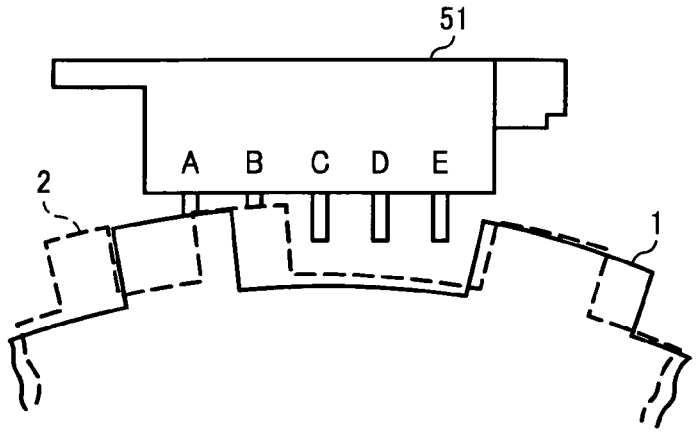
FIG. 10 is a diagram illustrating a pressed state of push switches in a combined concavo-convex pattern for an A4Y sheet size.

Subsequently, the sheet size detection device according to the present example embodiment will be described in detail on the basis of FIGS. 10 to 15. In the present example embodiment, the prevention of the above-described erroneous detection of the A4Y sheet size will be described as an example. FIG. 10 illustrates a state in which the A4Y sheet size is normally set. In the drawing, the levers 1 and 2 are indicated by a solid line and a broken line, respectively, for distinction therebetween. Further, for easier understanding, the levers 1 and 2 are illustrated with the positions thereof slightly displaced from each other.

Figure 12:
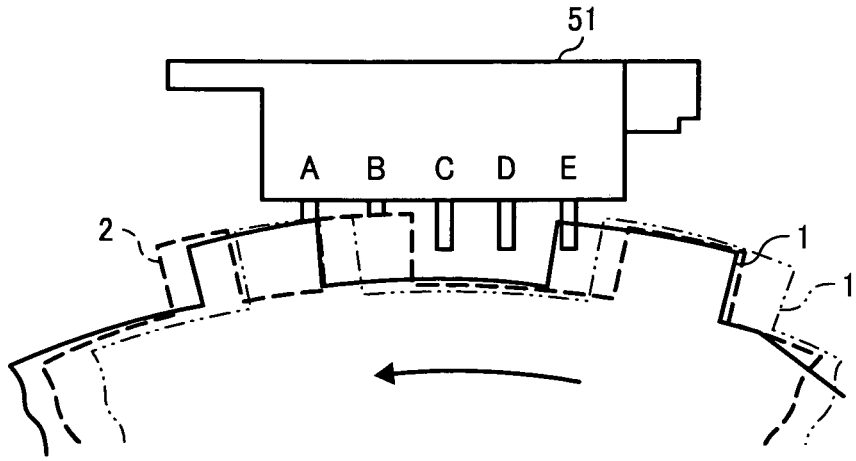
FIG. 12 is a diagram illustrating a pressed state of push switches in a combined concavo-convex pattern obtained in the erroneous setting of the A4Y sheet size.

In the present example, the combined detection pattern, i.e., the combined concavo-convex pattern is 11000. That is, the push switches A, B, C, D, and E have the values 1, 1, 0, 0, and 0, respectively. It is now assumed that the side fences 54*a* and 54*b* have been moved or displaced slightly outwardly for some reason. It is further assumed that the side fence positions have been shifted to side fence positions for a standard sheet size one size larger than the A4Y sheet size, i.e., that each of the side fences 54*a* and 54*b* has been fit in a notch device (not illustrated) set to the 12-inch width. In this case, as illustrated in FIG. 12, the lever 1 is rotationally moved in the direction indicated by an arrow in the drawing, i.e., the lever 1 shifts from the position indicated by an alternate long and two short dashes line to the position indicated by a solid line. As a result, a combined concavo-convex pattern 11001 is obtained.

Herein, it is assumed that the lever 2 corresponding to the end fence 52 has a fixed concavo-convex pattern 11000. This is due to the following reason. That is, as illustrated in FIG. 3, it is assumed in the present example embodiment that the setting direction of the sheet feeding tray 23 indicated by the arrow 6 is the same as the sliding direction of the side fences 54*a* and 54*b*. Therefore, there is a relatively high possibility that the width between the side fences 54*a* and 54*b* may be increased due to the shock caused in the setting of the sheet feeding tray 23 to the body of the image forming apparatus, as compared with a relatively low possibility of positional displacement occurring in the end fence 52.

Figure 13:
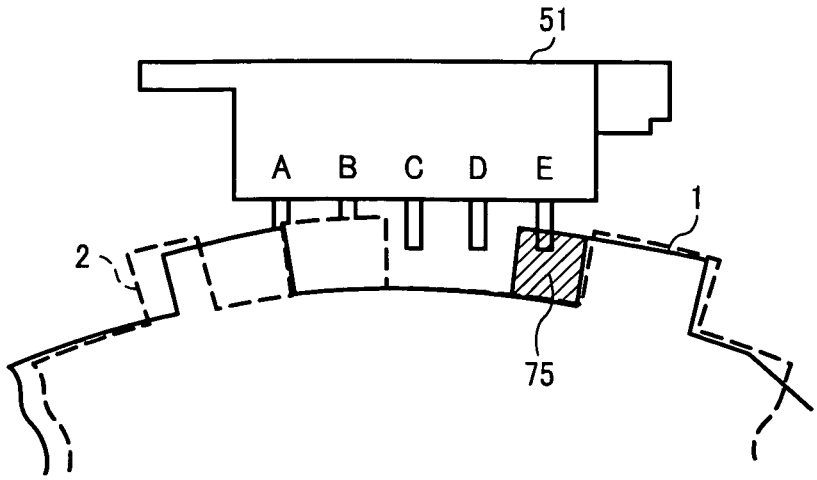
FIG. 13 is a diagram illustrating a method of preventing the erroneous setting of the A4Y sheet size, wherein a convex portion is removed.

For the recognition of the A4Y sheet size, however, each of the push switches C, D, and E needs to have the bit 0 with respect to the concavo-convex pattern of the lever 1 corresponding to the side fences 54*a* and 54*b*. That is, a hatched portion 75 illustrated in FIG. 13 is an unnecessary convex portion causing the erroneous detection.

In the present example, if the unnecessary hatched portion 75 is removed from the lever 1 corresponding to the side fences 54*a* and 54*b*, i.e., if the width in the rotation direction of the convex portion of the lever 1 is reduced, a shift from the concavo-convex pattern 10001 to the concavo-convex pattern 10000 can be easily attained. Such modification, however, conversely prevents the detection of the 12-inch width.

Figure 11:
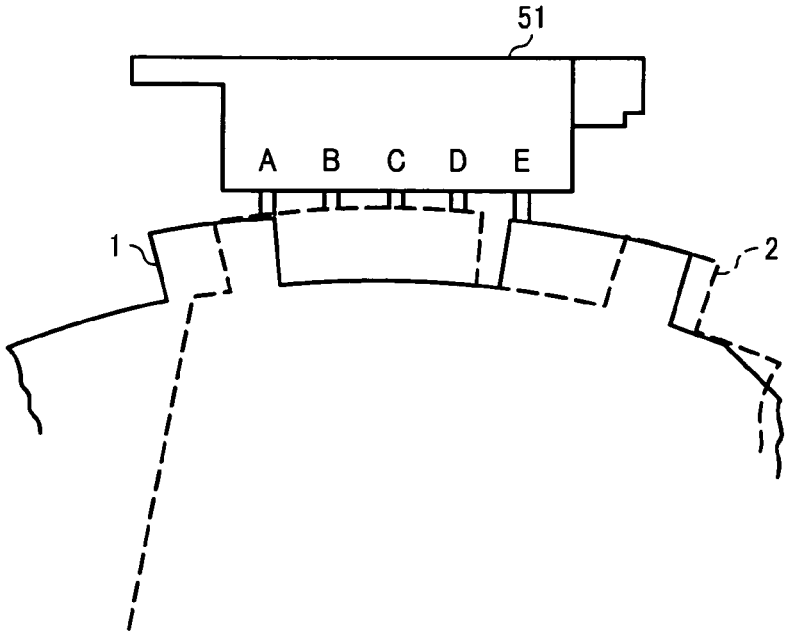
FIG. 11 is a diagram illustrating a pressed state of push switches in a combined concavo-convex pattern for a 12-inch by 18-inch sheet size.
Figure 14:
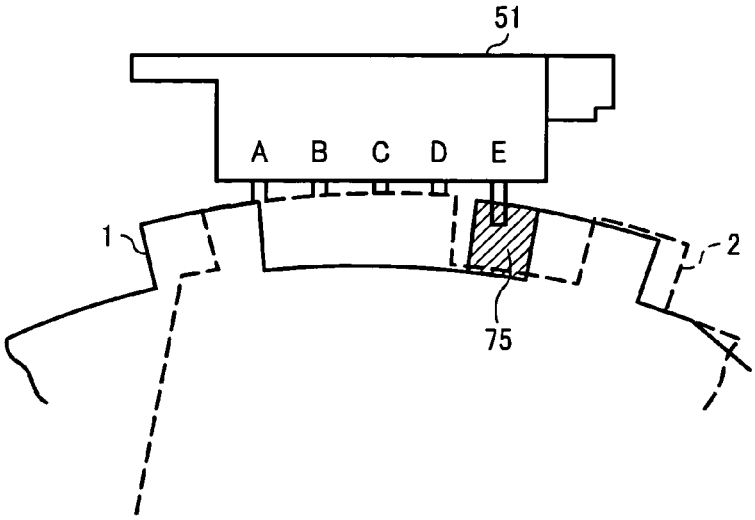
FIG. 14 is a diagram illustrating a side effect caused by the removal of the convex portion.

In the above case, if the standard sheet size having the 12-inch width is the 12-inch by 18-inch sheet size, the correct combined concavo-convex pattern is 11111, as illustrated in FIG. 11. As illustrated in FIG. 14, however, the correct combined concavo-convex pattern 11111 is shifted to the incorrect combined concavo-convex pattern 11110 due to the combination of the concavo-convex pattern 11110 corresponding to the end fence 52 and the concavo-convex pattern 10000 corresponding to the side fences 54*a* and 54*b*, which has been shifted from 10001. The thus shifted concavo-convex pattern corresponds to the combined concavo-convex pattern of an HLTY sheet size in the row number ten of FIG. 9. As a result, the sheet size is erroneously recognized as the smallest sheet size of HLTY in the fence setting for the largest sheet size of 12 inches by 18 inches.

Figure 15:
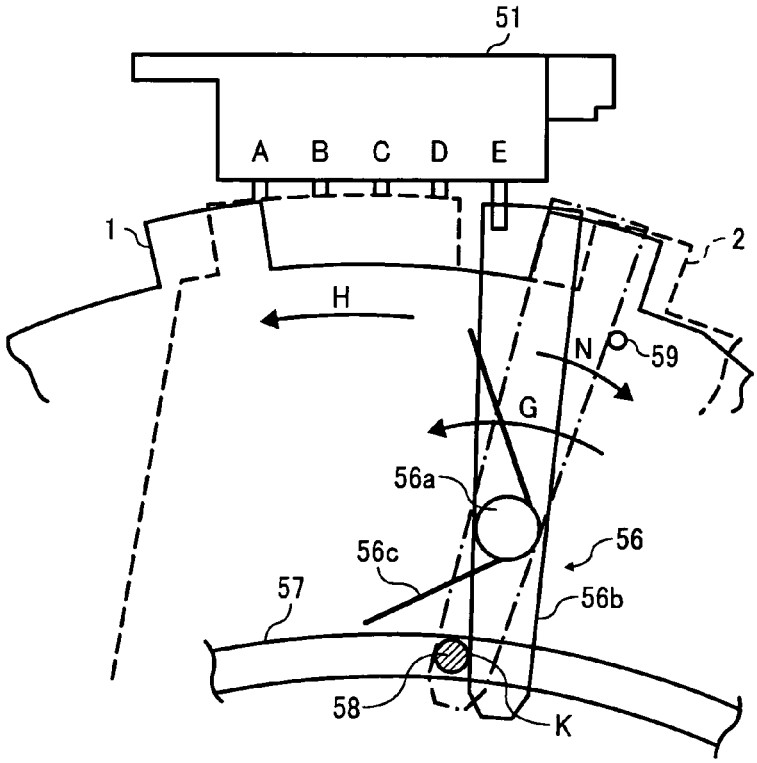
FIG. 15 is a diagram illustrating a configuration using a pattern supplementing device to prevent the side effect caused by the removal of the convex portion.

As illustrated in FIG. 15, therefore, to prevent the erroneous detection as the side effect caused by the removal of the convex portion, a pattern supplementing device 56 is provided to the lever 2 corresponding to the end fence 52 which regulates the longitudinal direction. The pattern supplementing device 56 is operated only when the end fence 52 is set at the 18-inch position. With this configuration, the desired combined pattern 11111 in the row number one of FIG. 9 is obtained.

As illustrated in FIG. 15, the pattern supplementing device 56 includes a supplementing plate 56*b* and a torsion spring 56*c*. The supplementing plate 56*b* is a band plate-like member swingably or rotatably supported by a rotation fulcrum 56*a* provided to the lever 2 corresponding to the end fence 52. The torsion spring 56*c* is a biasing member for biasing the supplementing plate 56*b* to prevent the erroneous detection due to the positional displacement.

The torsion spring 56*c* is fit and attached to the rotation fulcrum 56*a*. One free end of the torsion spring 56*c* at a lower position in the drawing is fixed onto the lever 2. The other free end of the torsion spring 56*c* is in contact with the supplementing plate 56*b*. With this configuration, the supplementing plate 56*b* is constantly biased in the direction indicated by an arrow N, and stays at a normal standby position indicated by an alternate long and short dash line, i.e., the position at which the supplementing plate 56*b* prevents the erroneous detection due to the positional displacement. The standby position is determined by a stopper 59.

The bottom surface of the sheet feeding tray 23 is provided with a projection 58 serving as a supplementing plate drive member not interfering with the two levers 1 and 2. In the present example, the levers 1 and 2 are formed with the groove 57 extending along the locus of the rotational movement of the levers 1 and 2, and the projection 58 is inserted through and engaged with the groove 57.

Along with the movement in the direction indicated by an arrow H of the lever 2 interlocking with the positioning movement of the end fence 52, the projection 58 comes into contact with a rear end portion of the supplementing plate 56*b*. Then, the supplementing plate 56*b* is rotationally moved in the direction indicated by an arrow G to be set at a supplementing position indicated by a solid line.

In the state in which the supplementing plate 56*b* is set at the supplementing position, a leading end portion of the supplementing plate 56*b* facing the detection sensor 51 acts on the convex portion of the lever 1 to supplement the removed hatched portion 75.

With the above configuration, the supplementing plate 56*b* can be rotated in the direction indicated by the arrow G at desired timing, i.e., at a desired position, and the leading end portion of the supplementing plate 56*b* is set at the position for pressing the push switch E.

Accordingly, the pattern supplementation causing the shift in the combined concavo-convex pattern from 11110 to 11111 can be performed only when the end fence 52 is set at the 18-inch position, i.e., the most outward position.

Subsequently, a second example embodiment of the present patent application will be described on the basis of FIGS. 16 to 18. In the present example embodiment, the same members as the members of the first example embodiment will be designated by the same reference numerals. Further, description of the already described configurations and functions will be omitted, unless particularly necessary, and only essential parts of the present example embodiment will be described.

In the first example embodiment, the supplementing plate 56*b* is the elongated plate-like member disposed on the upper surface of the lever 2 between the levers 1 and 2. In the present example embodiment, the pattern supplementing device is formed by a single member into a compact shape and disposed on the lower surface of the lever 2.

Figure 17:
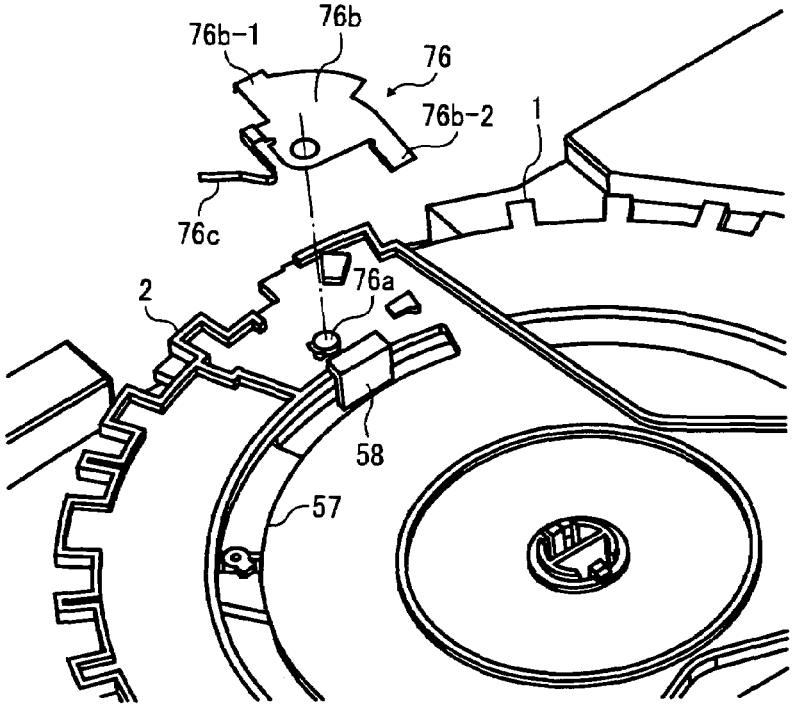
FIG. 17 is an exploded perspective view of the pattern supplementing device.
Figure 18:
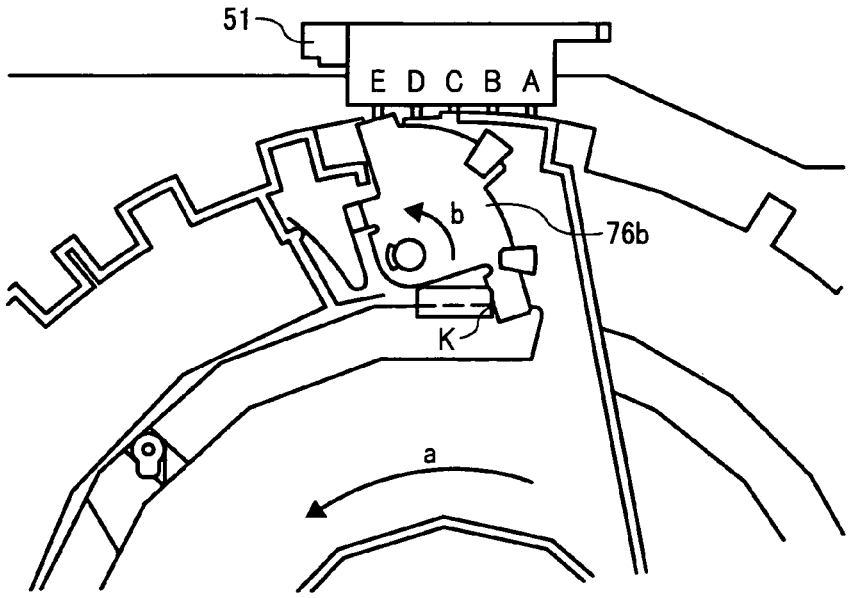
FIG. 18 is a perspective view of the pattern supplementing device at a supplementing position, as viewed from the back side of the sheet feeding tray.

As illustrated in the diagram of FIG. 17 illustrating the sheet feeding tray 23 as viewed from the back side, a pattern supplementing device 76 of the present example embodiment includes a supplementing plate 76*b* and a spring portion 76*c*. The supplementing plate 76*b* is rotatably and axially supported by a rotation fulcrum 76*a* formed integrally with the lower surface of the lever 2, and integrally includes a supplementing portion 76*b*-1 and a driven portion 76*b*-2. The supplementing portion 76*b*-1 corresponds to the leading end portion of the supplementing plate 56*b*, and the driven portion 76*b*-2 corresponds to a rear end portion of the supplementing plate 56*b*. The spring portion 76*c* serves as a biasing member. The above members are integrally formed of a resilient plate material, e.g., a plate spring by press working or the like. The sheet feeding tray 23 is provided with the projection 58 for driving the supplementing plate 76*b* at predetermined timing.

Figure 16:
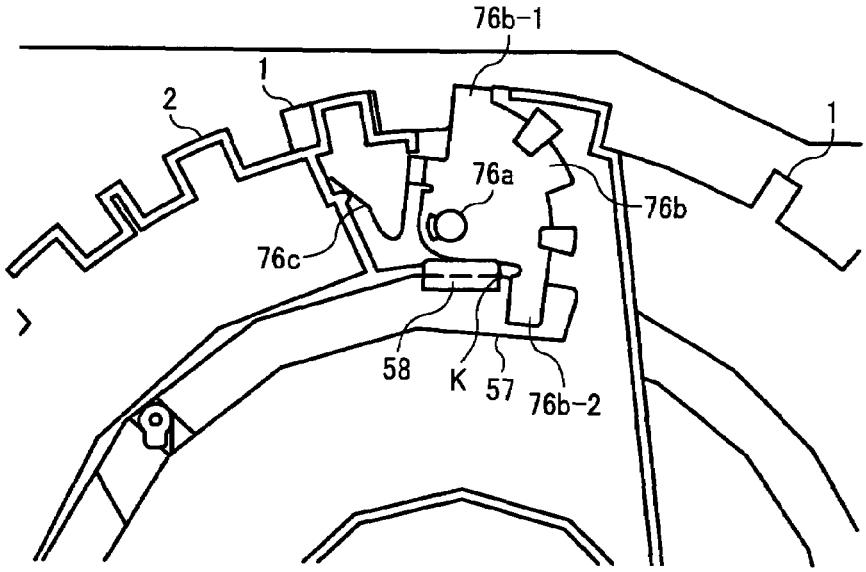
FIG. 16 is a plan view illustrating a pattern supplementing device according to a second example embodiment of the present patent application as viewed from the back side of the sheet feeding tray, particularly illustrating the pattern supplementing device before a supplementing operation.

FIG. 16 illustrates a state in which the supplementing plate 76*b* is set at a standby position by the biasing force of the spring portion 76*c*. As illustrated in FIG. 18, as the end fence 52 moves to the 18-inch position, the lever 2 is rotationally moved in the direction indicated by an arrow "a". Then, the driven portion 76*b*-2 is hit by a point K, and the supplementing plate 76*b* is rotationally moved in the direction indicated by an arrow "b". Thereby, the supplementing portion 76*b*-1 faces the push switch E to perform the pattern supplementation.

The pattern supplementing device 76 of the present example embodiment can be formed into a compact shape and disposed in a small space on the back surface of the lever 2. Therefore, the pattern supplementing device 76 can be more easily assembled than the pattern supplementing device 56 provided between the levers 1 and 2. Further, as described above, the pattern supplementing device 76 can be integrally formed of a resilient plate material, e.g., a plate spring. Thus, the production costs can be reduced.

In the configurations of the example embodiments described above, the pattern supplementing device 56 or 76 is provided to the lever 2 corresponding to the end fence 52 on the basis of the fact that the positional displacement is larger in the side fences 54*a* and 54*b* which regulate the insertion direction of the sheet feeding tray 23. The setting of the pattern supplementing device 56 or 76, however, is not limited thereto. Thus, if at least one pattern supplementing device is provided to either or both of the levers 1 and 2 to obtain desired patterns, responses to a variety of situations can be provided.

If the insertion direction of the sheet feeding tray 23 is regulated by the end fence 52, the pattern supplementing device may be provided to the lever 1 corresponding to the side fences 54*a* and 54*b*. Further, the lever of the fence provided with the pattern supplementing device may be determined on the basis of the difference in the slide pitch, i.e., the positioning pitch between the side fences 54*a* and 54*b* and the end fence 52. This is based on a tendency of the positional displacement to occur in a fence having a small slide pitch.

In the configurations of the example embodiments described above, the projection 58 serving as the supplementing plate drive member for driving the supplementing plate 56*b* or 76*b* is provided to the sheet feeding tray 23. Alternatively, the supplementing plate drive member may be provided to the body of the image forming apparatus. For example, a stick-like member fixed to the body of the image forming apparatus and horizontally extending between the levers 1 and 2 can drive the supplementing plate 56*b* or 76*b*.

Further, the pattern supplementing device 56 or 76 may be provided to the body of the image forming apparatus. In this case, the pattern supplementing device 56 or 76 may be configured to operate in an interlocking manner with the operation of the side fences 54*a* and 54*b* or the end fence 52, or to operate independently of the operation of the side fences 54*a* and 54*b* or the end fence 52.

Further, the pattern supplementing device 56 or 76 may be configured to be manually switched on and off. If the pattern supplementing device 56 or 76 is set only when the 12-inch by 18-inch sheet size is used, functions similar to the functions described above can be obtained. In this case, if the first example embodiment is used, the pattern supplementing device 56 is provided to the lever 1 corresponding to the side fences 54*a* and 54*b* and having the concavo-convex pattern including the removed convex portion. Further, if the rotation fulcrum 56*a* of the pattern supplementing device 56 is provided on the lever 1, a more compact configuration can be provided. Furthermore, even if the moving distance of the lever 1 is short, i.e., even if the stroke of the lever 1 is short, the supplementing plate 56*b* can be rotationally moved in a reliable and prompt manner.

Figure 19:
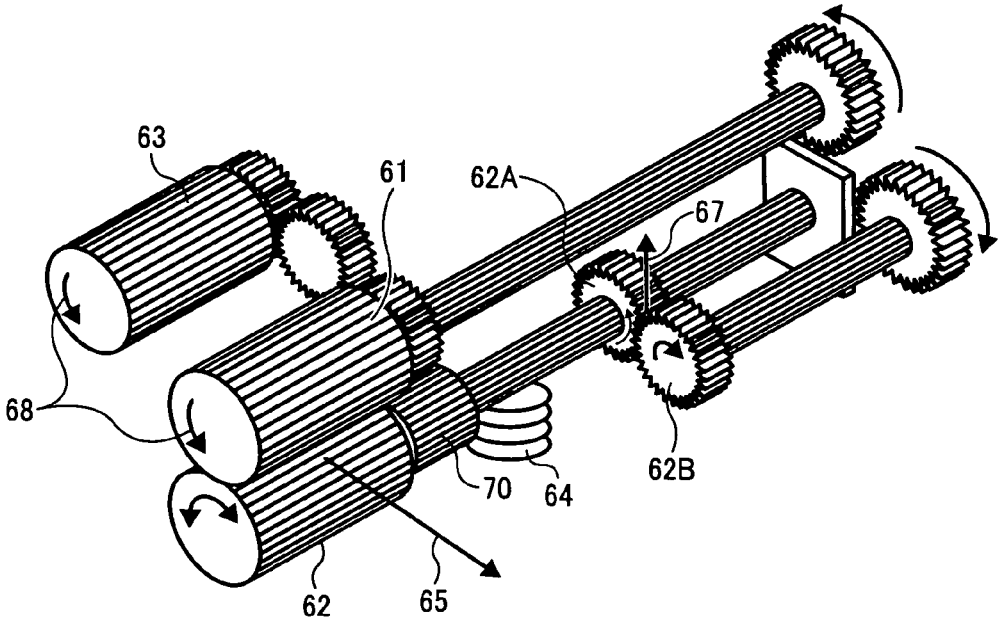
FIG. 19 is a perspective view illustrating a sheet separating configuration of a sheet feeding device.

FIG. 19 illustrates a sheet separating, configuration of a sheet feeding device, to which the present patent application is applied. Description will be made of a sheet feeding device for separating and conveying recording sheets by nipping each of the recording sheets between a feed roller and a separating, member which comes into pressure contact with the feed roller, particularly of an FRR (Feed and Reverse Roller) separating device in the present example. The FRR separation device is a sheet feeding device capable of separating and conveying the recording sheets in a sheet-by-sheet manner on the basis of operations described below.

FIG. 19 illustrates a feed roller 61, a reverse roller 62, a pick-up roller 63, a spring 64, and a torque limiter 70. The reverse roller 62 is provided with a driven gear 62A meshing with a drive gear 62B. In FIG. 19, one of the stacked recording sheets (not illustrated) is guided to the feed roller 61 by the pick-up roller 63. The feed roller 61 is rotated in a sheet feeding direction 68, and is supplied with predetermined torque by the torque limiter 70 in the opposite direction to the sheet feeding direction 68. The torque is supplied via the driven gear 62A, which is provided to the shaft of the reverse roller 62 to mesh with the drive gear 62B, by teeth surface pressure 67 acting between the drive gear 62B and the driven gear 62A and initial pressure. Along with the driving of the reverse roller 62 brought into pressure contact with the feed roller 61 by the force of a resilient member, i.e., the spring 64 in this example, the FRR separating device separates and conveys the recording sheets in a sheet-by-sheet manner.

In the sheet separating mechanism as described above, if the reverse roller 62 performs a sheet separating operation until the recording sheet passes through the nip between the feed roller 61 and the reverse roller 62, the recording sheets can be prevented from being conveyed in an unseparated or overlapped manner due to adhesion between the recording sheets. If the feed roller 61 is stopped and the reverse roller 62 is driven, however, force in the opposite direction to the sheet feeding direction 68 is applied to the recording sheets due to the load of the torque limiter 70. As a result, the slip of the recording sheets is increased.

In view of the above, the feed roller 61 is driven. However, if the feed roller 61 is not stopped before the recording sheet passes through the nip between the feed roller 61 and the reverse roller 62, the subsequent recording sheet may also be conveyed. Thus, the feed roller 61 is stopped before the passage of the recording sheet through the nip. If the time point for stopping the feed roller 61 is precise, the slip of the recording sheets can be minimized due to the increase in the driving time of the feeding roller 61. Therefore, if the sheet size is accurately detected, relatively highly accurate sheet conveyance can be performed.

Figure 20:
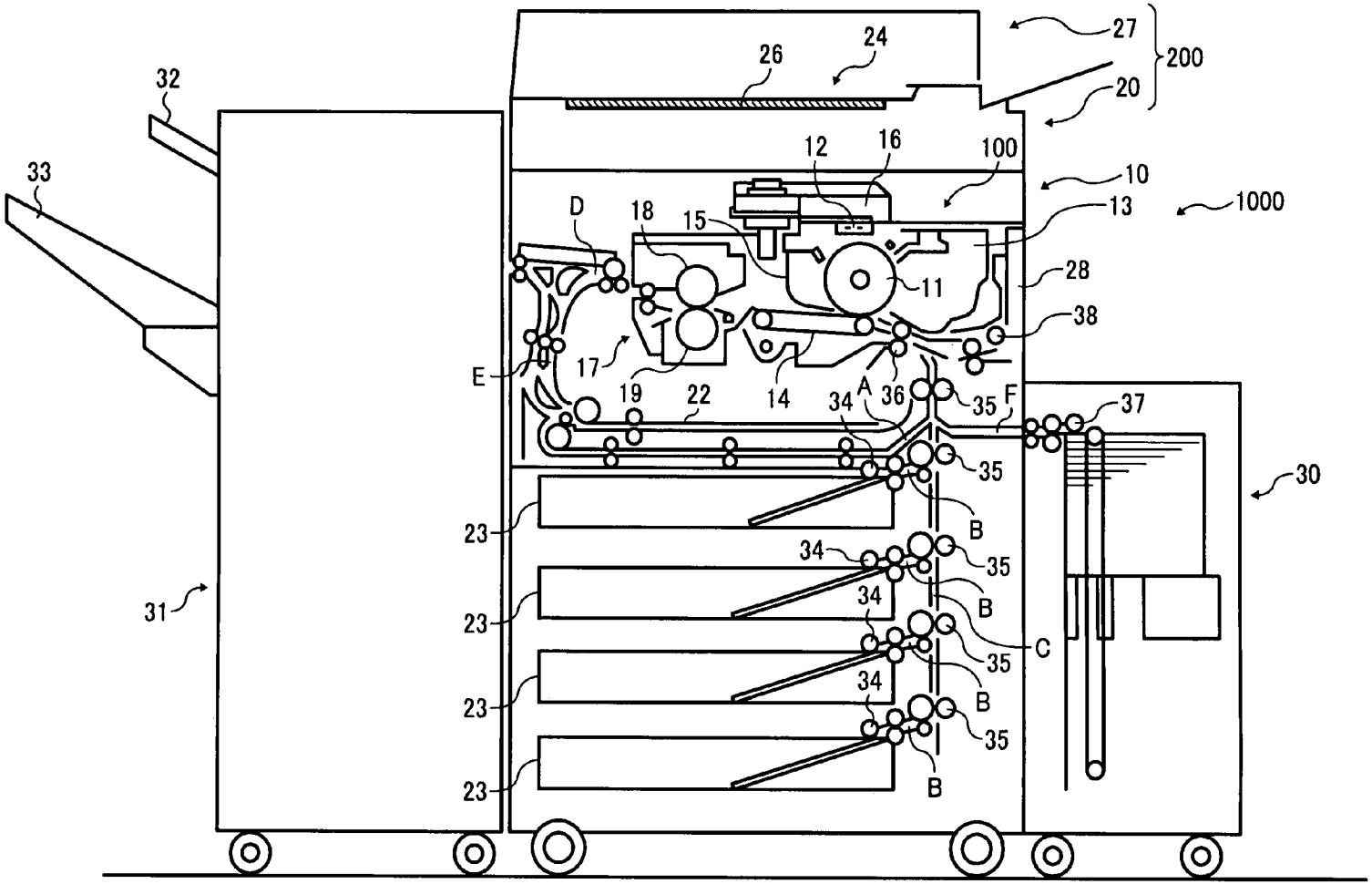
FIG. 20 is a schematic configuration diagram of the image forming apparatus.

FIG. 20 illustrates a third example embodiment of the present patent application, in which an image forming apparatus 1000 includes the sheet feeding tray 23 described above. An image forming apparatus body 10 that is included in the image forming apparatus 1000 includes an image forming unit 100. The image forming unit 100 includes an image carrying member or a photoconductor 11 formed over a drum member and surrounded by a charging device 12, a development device 13, a transfer and conveyance device 14, a cleaning device 15, and so forth. The image carrying member 11, the transfer and conveyance device 14, and the cleaning device 15 form a single unit, i.e., a process cartridge.

Further, a laser writing device 16 is provided above the image forming unit 100. Although illustration is omitted, the laser writing device 16 includes a light source such as a laser diode, a rotary polygon mirror for scanning, a polygon motor, an optical scanning system including an f-theta lens and mirrors, and so forth.

On the left side of the cleaning device 15 in the drawing, a fixing device 17 is provided. The fixing device 17 includes a fixing roller 18 including a heater and a pressure roller 19 pressed from below against the fixing roller 18.

The image forming apparatus body 10 further includes in a lower part thereof a duplex unit 22 and four vertically arranged sheet feeding trays or sheet feeding cassettes 23. Each of the sheet feeding trays 23 stores recording sheets or sheet materials, such as paper sheets and OHP (Over Head Projector) sheets. The duplex unit 22 is connected to a sheet re-feeding path A. The sheet feeding trays 23 are connected to respective sheet supply paths B. The re-feeding path A and the sheet supply paths B lead to a common sheet feeding path C extending to a position under the image carrying member 11. The duplex unit 22 forms a sheet reversing path E branching from an intermediate point of a sheet discharge path D extending from the exit of the fixing device 17.

On the upper surface of the image forming apparatus body 10, a contact glass 26 is provided on an image scanning unit 24. Further, on the image forming apparatus body 10, an automatic document conveying device 27 is openably and closably provided to cover the contact glass 26. The automatic document conveying device 27 and an optical scanning device 20 form an image scanning device 200.

On the right side of the image forming apparatus body 10 in the drawing, a manual sheet feeding tray 28 is openably and closably provided to guide a manually set recording sheet into the sheet feeding path C. Further, a mass sheet feeding device 30 is externally attached to the image forming apparatus body 10. The mass sheet feeding device 30 stores a stack of recording sheets, and can raise and lower the recording sheets.

On the left side of the image forming apparatus body 10 in the drawing, a sheet post-processing device 31 is externally attached to the image forming apparatus body 10. The sheet post-processing device 31 includes an upper tray 32 and a lower tray 33. The sheet post-processing device 31 receives the recording sheet discharged through the sheet discharge path D. Then, the sheet post-processing device 31 directly discharges the recording sheet to the upper tray 32, or performs post-processes such as stapling and punching on the recording sheet and discharges the processed recording sheet to the upper tray 32 or the lower tray 33.

In a copying operation using the image forming apparatus as described above, an original document is set on the automatic document conveying device 27, or is directly set on the contact glass 26 after the automatic document conveying device 27 is opened. Then, upon pressing of a start switch, not illustrated, the optical scanning device 20 starts scanning the document.

At the same time, an appropriate one of sheet feeding rollers 34 is rotated to send out a recording sheet from the corresponding one of the multiple sheet feeding trays 23 provided in the image forming apparatus body 10. The thus sent out recording sheet is conveyed into the sheet feeding path C through the corresponding sheet supply path B, conveyed by the corresponding conveyance roller 35, and hit and stopped by a registration roller pair 36. The registration roller pair 36 is rotated at proper timing with the rotation of the image carrying member 11, and the recording sheet is sent to the position under the image carrying member 11 of the image forming unit 100.

Alternatively, a sheet feeding roller 37 is rotated to feed a recording sheet from the mass sheet feeding device 30. Then, the recording sheet is conveyed into the sheet feeding path C through a sheet conveyance path F, conveyed by the corresponding conveyance roller 35, and hit and stopped by the registration roller pair 36. Still alternatively, a sheet feeding roller 38 provided in a manual sheet feeding unit is rotated. Then, a recording sheet set on the opened manual sheet feeding tray 28 is conveyed into the sheet feeding path C and hit and stopped by the registration roller pair 36 in a similar manner. The registration roller pair 36 is then rotated at proper timing with the rotation of the image carrying member 11, and the recording sheet is sent to the position under the image carrying member 11 of the image forming unit 100.

Meanwhile, upon pressing of the start switch (not illustrated), the image carrying member 11 of the image forming unit 100 is rotated in the clockwise direction in the drawing at the same time as the operations described above. As the image carrying member 11 is rotated, a surface of the image carrying member 11 is first uniformly charged by the charging device 12, and then is applied with a laser beam in accordance with the data scanned by the optical scanning device 20. Thereby, the writing process by the laser writing device 16 is performed. As a result, an electrostatic latent image is formed on the surface of the image carrying member 11, and toner is adhered to the electrostatic latent image by the development device 13. Thereby, the electrostatic latent image is developed into a visible toner image.

Then, in the transfer and conveyance device 14, the visible toner image is transferred onto the recording sheet sent to the position under the image carrying member 11 as described above. After the transfer of the toner image, the cleaning device 15 cleans the surface of the image carrying member 11 by removing the toner remaining on the surface. Thereby, the image carrying member 11 is prepared for the next similar image forming operation.

After the transfer of the toner image, the recording sheet is conveyed into the fixing device 17 by the transfer and conveyance device 14. In the fixing device 17, the recording sheet is applied with heat and pressure by the fixing roller 18 and the pressure roller 19. Thereby, the transferred toner image is fixed on the recording sheet. Thereafter, the recording sheet is discharged through the sheet discharge path D to the sheet post-processing device 31.

In the formation of images on both surfaces of the recording sheet, the recording sheet is conveyed into the sheet reversing path E from an intermediate point of the sheet discharge path D and reversed and re-fed by the duplex unit 22. Then, in the transfer and conveyance device 14, another toner image formed on the image carrying member 11 is transferred onto the back surface of the recording sheet. Thereafter, the transferred toner image is fixed on the recording sheet in the fixing device 17, and the recording sheet is discharged to the sheet post-processing device 31.

The above-described example embodiments are illustrative and do not limit the present patent application. Thus, numerous additional modifications and variations are possible in light of the above teachings. For example, elements at least one of features of different illustrative and example embodiments herein may be combined with each other at least one of substituted for each other within the scope of this disclosure and appended claims. Further, features of components of the example embodiments, such as the number, the position, and the shape, are not limited the example embodiments and thus may be preferably set. It is therefore to be understood that within the scope of the appended claims, the disclosure of this patent specification may be practiced otherwise than as specifically described herein.

The invention claimed is:

1. A sheet size detection device for detecting multiple sheet sizes, the sheet size detection device comprising:

a sheet width direction regulating member slidably positionable in accordance with the sheet size of a recording sheet to regulate a sheet width direction;

a sheet conveyance direction regulating member slidably positionable in accordance with the sheet size of the recording sheet to regulate a sheet conveyance direction substantially perpendicular to the sheet width direction;

two levers each having a concavo-convex pattern, interlocking with the sheet width direction regulating member and the sheet conveyance direction regulating member, respectively, and superimposed in a sheet stacking direction to have the same center of rotation and the same locus formed by a leading end of the concavo-convex pattern away from the center of rotation, the concavo-convex pattern of at least one of the levers shaped to prevent, in a particular detection pattern, erroneous detection attributed to positional displacement of the concavo-convex pattern;

a detection sensor including multiple push switches to detect the sheet size of the recording sheet in accordance with a combined concavo-convex pattern formed by the superimposed levers to selectively press the push switches; and a pattern supplementing device configured to supplement the concavo-convex pattern of the at least one lever at the leading end of the concavo-convex pattern to prevent, in another detection pattern, erroneous detection attributed to the shaping of the concavo-convex pattern for preventing the erroneous detection attributed to the positional displacement of the concavo-convex pattern with respect to the push switches.

2. An image forming apparatus comprising:

an image forming mechanism configured to form an image on a recording sheet; and the sheet size detection device according to claim 1.

3. The sheet size detection device as described in claim 1, wherein the sheet width direction regulating member, the sheet conveyance direction regulating member, and the two levers are provided to a sheet feeding tray configured to store the recording sheet and detachably attached to the body of an image forming apparatus, the detection sensor provided to the body of the image forming apparatus to face the combined concavo-convex pattern when the sheet feeding tray is attached to the body of the image forming apparatus.

4. The sheet size detection device as described in claim 3, wherein the pattern supplementing device is operated at a timing at which the concavo-convex pattern needs to be supplemented.

5. The sheet size detection device as described in claim 4, wherein, in the concavo-convex pattern of the at least one lever, a width in the rotation direction of a convex portion is reduced to shape the concavo-convex pattern to prevent the erroneous detection attributed to the positional displacement, the pattern supplementing device having a shape for supplementing the width-reduced part of the convex portion.

6. The sheet size detection device as described in claim 4, wherein the pattern supplementing device interlocks with a positioning operation of the regulating member corresponding to the other lever different from the at least one lever, the pattern supplementing device set at a supplementing position upon positioning of the regulating member corresponding to the other lever.

7. The sheet size detection device as described in claim 6, wherein a regulating direction of the regulating member corresponding to the at least one lever is equal to an insertion direction of the sheet feeding tray.

8. The sheet size detection device as described in claim 6, wherein a slide pitch of the regulating member corresponding to the at least one lever is equal to or less than the slide pitch of the regulating member corresponding to the other lever.

9. The sheet size detection device as described in claim 6, wherein the pattern supplementing device includes:

a supplementing plate rotatably and axially supported by the other lever; and a biasing member configured to bias the supplementing plate to prevent the erroneous detection attributed to the positional displacement, the sheet size detection device further comprising a supplementing plate drive member configured to come into contact with and setting the supplementing plate at the supplementing position upon positioning of the regulating member corresponding to the other lever.

10. The sheet size detection device as described in claim 9, wherein the supplementing plate and the biasing member are formed by a single member.

11. The sheet size detection device as described in claim 9, wherein the supplementing plate drive member is provided to the sheet feeding tray.

12. The sheet size detection device as described in claim 9, wherein the supplementing plate drive member is provided to the body of the image forming apparatus.

13. A sheet size detection method for detecting multiple sheet sizes, the sheet size detection method comprising:

forming a concavo-convex pattern in each of two levers so that the concavo-convex pattern of at least one of the levers is shaped to prevent, in a particular detection pattern, erroneous detection attributed to positional displacement of the concavo-convex pattern with respect to multiple push switches forming a detection sensor;

superimposing the levers in a sheet stacking direction such that the levers have the same center of rotation and the same locus formed by a leading end of the concavo-convex pattern away from the center of rotation;

regulating a sheet width direction in accordance with the sheet size of a recording sheet;

regulating a sheet conveyance direction substantially perpendicular to the sheet width direction in accordance with the sheet size of the recording sheet;

supplementing, when necessary, the concavo-convex pattern of the at least one lever at the leading end of the concavo-convex pattern has been added to prevent, in another detection pattern, erroneous detection attributed to the shaping of the concavo-convex pattern of the at least one lever; and detecting the sheet size of the recording sheet in accordance with a combined concavo-convex pattern formed by the superimposed levers to selectively press the push switches.

* * * * *